US006561626B1

(12) United States Patent
Min et al.

(10) Patent No.: US 6,561,626 B1
(45) Date of Patent: May 13, 2003

(54) INK-JET PRINT HEAD AND METHOD THEREOF

(75) Inventors: Jae-sik Min, Gyeonggi-do (KR); Seo-hyun Cho, Gyeonggi-do (KR); Sang-wook Lee, Gyeonggi-do (KR); Jun-hyub Park, Gyeonggi-do (KR); Yong-shik Park, Gyeonggi-do (KR); Kyong-il Kim, Gyeonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/121,723

(22) Filed: Apr. 15, 2002

(30) Foreign Application Priority Data

Dec. 18, 2001 (KR) ..... 2001-80902

(51) Int. Cl.[7] ..... B41J 2/14; B41J 2/16; B41J 2/05

(52) U.S. Cl. ..... 347/47; 347/63

(58) Field of Search ..... 347/17, 44, 45, 347/47, 54, 56, 64, 63, 65, 67, 92, 94, 62

(56) References Cited

U.S. PATENT DOCUMENTS 4,847,630 A 7/1989 Bhaskar et al. ..... 347/63
5,760,804 A 6/1998 Heinzl et al. ..... 347/56
5,841,452 A * 11/1998 Silverbrook ..... 347/47
6,019,457 A 2/2000 Silverbrook ..... 347/65

* cited by examiner

*Primary Examiner*—Craig Hallacher
*Assistant Examiner*—Juanita Stephens
(74) *Attorney, Agent, or Firm*—Staas & Halsey LLP

(57) ABSTRACT

An ink-jet print head preventing thermal accumulation on a nozzle plate includes a substrate, a channel formed in the substrate to supply ink, a nozzle plate connected to the substrate and including a nozzle corresponding to the channel, a heat element formed in the nozzle plate to surround the nozzle, a thermal conduction layer formed on an upper side of the heat element formed between the thermal conduction layer and the heat element, and a thermal shunt spaced-apart from the heat element by a predetermined distance not to overlap the heat element in a direction parallel to the nozzle plate and connecting the thermal conduction layer to the substrate. Redundant heat generated from the heat element is not accumulated on a membrane of the nozzle plate but is rapidly absorbed into an inorganic thermal conduction layer formed in the membrane and is transferred to the bulk silicon substrate through a metallic thermal bridge, such as the thermal shunt.

50 Claims, 7 Drawing Sheets

INK-JET PRINT HEAD AND METHOD THEREOF

CROSS-REFERENCE TO RELATED APPLICATIONS

This application claims the benefit of Korean Patent Application No. 2001-80902, filed Dec. 18, 2001, in the Korean Industrial Property office, the disclosure of which is incorporated herein by reference.

BACKGROUND OF THE INVENTION

1. Field of the Invention

The present invention relates to an ink-jet print head, and more particularly, to an ink-jet print head having a nozzle plate, a heat element formed on the nozzle plate, and a thermal shunt formed in the nozzle plate such that thermal accumulation on the nozzle plate can be effectively prevented.

2. Description of the Related Art

Ink ejection mechanisms of ink-jet print heads include an electro-thermal transducer having a heat source generating bubbles to eject ink by using a bubble-jet method, and an electro-mechanical transducer having a piezoelectric device varying a volume of the ink caused by deformation of the piezoelectric device to eject the ink.

The bubble-jet method of the electro-thermal transducer is classified into a top-shooting method, a side-shooting method, and a back-shooting method according to a relationship between a growing direction of the bubbles and an ejecting direction of an ink droplet of the ink. In the top-shooting method, the growing direction of the bubbles is the same as the ejecting direction of the ink droplet, in the side-shooting method, the growing direction of the bubbles is perpendicular to the ejecting direction of the ink droplet, and in the back-shooting method, the growing direction of the bubbles is opposite to the ejecting direction of the ink droplet.

A basic principle of the back-shooting method and a structure of an ink-jet print head using the same are disclosed in U.S. Pat. No. 5,760,804 to Heinzl et al. issued Jun. 2, 1998. In addition, various structures used for the back-shooting method are disclosed in U.S. Pat. No. 4,847,630 to Bhaskar et al. issued Jul. 11, 1989 and U.S. Pat. No. 6,019,457 to Silverbrook issued Feb. 1, 2000.

FIG. 1 is a cross-sectional view of a conventional ink-jet print head.

A chamber 1*a* having a hemispheric shape is formed in a substrate 1, which is formed of silicon, etc., and an ink inlet 1*b* connected to an ink supply source (not shown) is formed in a lower portion of the chamber 1*a*. A nozzle plate 2 is formed on the substrate 1 and above the chamber 1*a,* a nozzle 3 is formed in the nozzle plate 2, and an ink droplet 15*a* is ejected from the nozzle 3.

The nozzle plate 2 includes a thermal insulation layer 2*a* and a chemical vapor deposition (CVD) overcoat 2*b* formed on the thermal insulation layer 2*a*. The insulation layer 2*a* and the CVD overcoat 2*b* correspond to a portion of the substrate 1. The insulation layer 2*a* has a first surface facing the substrate 1 and a second surface contacting the heat element 8.

A heat element 8 is disposed adjacent to the nozzle 3 to surround the nozzle 3. The heat element 8 is disposed in an interface area between the thermal insulation layer 2*a* and the overcoat 2*b,* and a thermal shunt 9 transferring heat from the heat element 8 to ink 15 in the chamber 1*a* and transferring redundant heat to the substrate 1 through the insulation layer 2*a* is formed above an upper side of the heat element 8.

In the conventional ink-jet print head, if a current pulse is applied to the heat element 8, the heat is generated from the heat element 8, and bubbles 7 are formed from the first surface of the insulation layer 2*a*. After that, while heat is continuously generated from the heat element 8, the heat is continuously supplied to the bubbles 7, and thus the bubbles 7 expand. Due to the expansion of the bubbles 7, pressure is applied to the ink 15 disposed in the chamber 1*a,* and thus the droplet 15*a* of the ink 15 in a vicinity of the nozzle 3 is ejected to an outside of the nozzle plate 2 through the nozzle 3. After that, additional ink 15 is sucked into the chamber 1*a* along an ink channel or passage direction 5, and thus the chamber 1*a* is refilled with the additional ink 15.

In the conventional ink-jet print head using the back-shooting method, as described above, the heat element 8 arranged around the nozzle 3 of the nozzle plate 2 is formed between the insulation layer 2*a* and the overcoat 2*b,* which constitute the nozzle plate 2, and the heat element 8 is connected to an electric line (not shown) to receive current from a power source. The electric line is also formed between the insulation layer 2*a* and the overcoat 2*b*.

If the current is supplied to the heat element 8, heat generated from the heat element 8 is transferred to the ink 15 in the chamber 1*a,* and thus the bubbles 7 are formed in the ink 15. However, remaining redundant heat may be accumulated on the nozzle plate 2, but the thermal accumulation of the remaining redundant heat is prevented by the thermal shunt 9. In other words, the thermal shunt 9 prevents the thermal accumulation on the nozzle plate 2. The temperature of the nozzle plate 2 raised by the remaining redundant heat, which has not been transferred to the ink 15 in the chamber 1*a,* is lowered when the remaining redundant heat is transmitted to the substrate 1. If the temperature of the nozzle plate 2 is increased to more than a predetermined temperature, a lifetime of the ink-jet print head is shortened, and the performance of an ink-jet ejection operation is lowered. The problem with the thermal accumulation may not occur in a structure in which the heat element 8 is directly formed on the substrate 1 but occurs in another structure having the heat element 8 formed on a portion spaced-apart from the substrate 1, for example, on the nozzle plate 2 having a membrane structure with a large heat transfer resistance as shown in FIG. 1.

Likewise, in the ink-jet print head having the heat element 8 formed on the nozzle plate 2, the thermal shunt 9 is used to improve the above thermal accumulation. However, with the thermal shunt 9 of the conventional ink-jet print head, it is very difficult to efficiently transfer or radiate the remaining redundant heat to the substrate 1. In addition, the thermal shunt 9 is made of a conductor, such as aluminum, and is extended above the heat element 8 and between upper and lower material layers. Since the thermal shunt 9 is disposed very close to the heat element 8, cracks are generated due to the thermal stress caused by a difference between thermal expansion coefficients of the thermal shunt 9 and the upper and lower material layers.

SUMMARY OF THE INVENTION

To solve the above problems, it is an object of the present invention to provide an ink-jet print head, which is capable of more effectively preventing excessive thermal accumulation on a nozzle plate.

Additional objects and advantageous of the invention will be set forth in part in the description which follows and, in part, will be obvious from the description, or may be learned by practice of the invention.

Accordingly, to achieve the above and other objects, there is provided an ink-jet print head. The ink-jet print head includes a substrate, a channel formed on the substrate to supply ink in an ink passage direction, a nozzle plate connected to the substrate and including a nozzle corresponding to the channel, a heat element disposed in the nozzle plate to surround the nozzle, a thermal conduction layer formed on an upper side of the heat element, an intermediate insulation layer formed between the thermal conduction layer and the heat element, and a first thermal shunt spaced-apart from the heat element by a predetermined interval in a direction parallel to a major surface of the nozzle plate not to overlap the heat element and connecting the thermal conduction layer to the substrate.

The thermal conduction layer is made of diamond like carbon (DLC) or silicon carbide (SiC), and a passivation layer is formed on an upper surface of the thermal conduction layer, and a hydrophobic layer is formed on the passivation layer.

An electrode applying current to the heat element is formed on the nozzle plate, and the first thermal shunt is formed of the same material as that of the electrode.

The first thermal shunt includes first and second metal layers formed on the nozzle plate, an insulation layer is formed between the first and second metal layers, and a first through hole formed on the insulation layer to allow the first and second metal layers to contact each other. Here, the first through hole is spaced-apart from a wall defining the chamber so as not to thermally affect the ink in the chamber. The electrode includes a first electrode directly connected to the heat element and a second electrode formed on an upper layer formed on the first electrode, an insulation layer formed between the first electrode and the second electrode, and a second through hole formed on the insulation layer to allow the first electrode to be electrically connected to the second electrode. Thereby, a second thermal shunt including the first and second electrodes is provided. The first and second thermal shunts surround the heat element at a predetermined interval.

The above and other objects are achieved by providing a structure in which redundant heat generated from the heat element can be effectively transferred to a bulk silicon substrate in the ink-jet print head using a back-shooting method in which the heat element is spaced-apart from the substrate. That is, the ink-jet print head includes a membrane. The chamber having a hemispheric shape is formed in the membrane, and the nozzle is formed above the chamber of the membrane. A thermal conduction layer is made of the DLC or the SiC to absorb the heat generated from the heat element and formed above the heat element with by the predetermined interval in the direction parallel to the major surface of the nozzle plate or parallel to a plane disposed between the nozzle plate and the substrate. A thermal shunt or bridge is formed between the thermal conduction layer and the substrate and spaced-apart from the heat element to rapidly transfer the heat from the thermal conduction layer to the substrate. An insulation layer having a predetermined thickness is made of a material having thermal conductivity lower than the DLC, such as an inter-metal dielectric (IMD) material, and disposed between the thermal conduction layer and the heat element, and thereby preventing the heat generated from the heat element from being excessively absorbed into the thermal conduction layer. Due to the excessive absorption and exhaustion of the heat, it is very difficult to effectively generate the bubbles.

The thermal conduction layer has an electrical insulation characteristic and is made of an inorganic material having a very high thermal conductivity and a low thermal expansion rate lower than a metal. As a result, the occurrence of the cracks caused by the thermal stress is prevented. The thermal shunt connecting the thermal conduction layer to the substrate is spaced-apart from the heat element by the predetermined second vertical distance and is simultaneously formed with the electrode constituting an electric circuit for the heat element. Thus, a design for the thermal shunt is applied to a mask forming the electrode in the nozzle plate when the electrode is formed, and thereby the thermal shunt is formed together when the electrode having one or two metal layers is formed.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENTS

Figure 1:
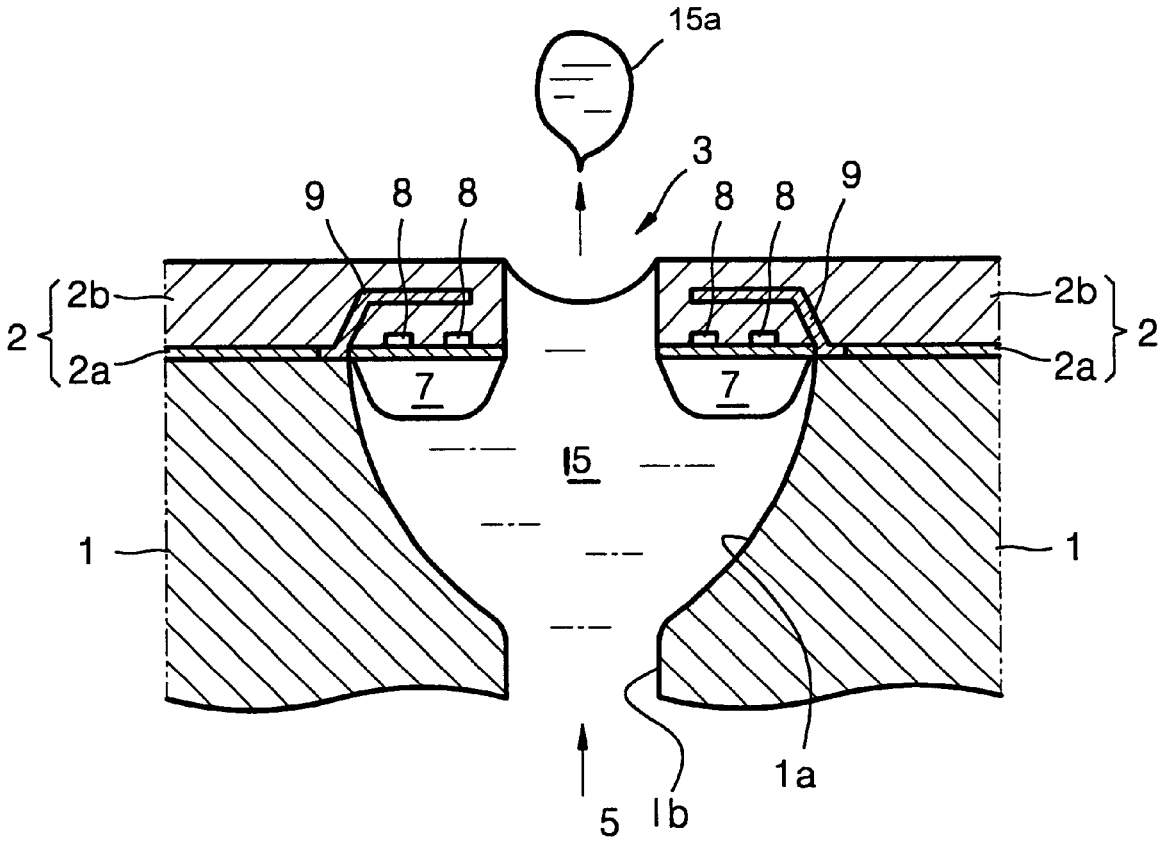
FIG. 1 (PRIOR ART)
FIG. 1 illustrates a conventional ink-jet print head.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Figure 2:
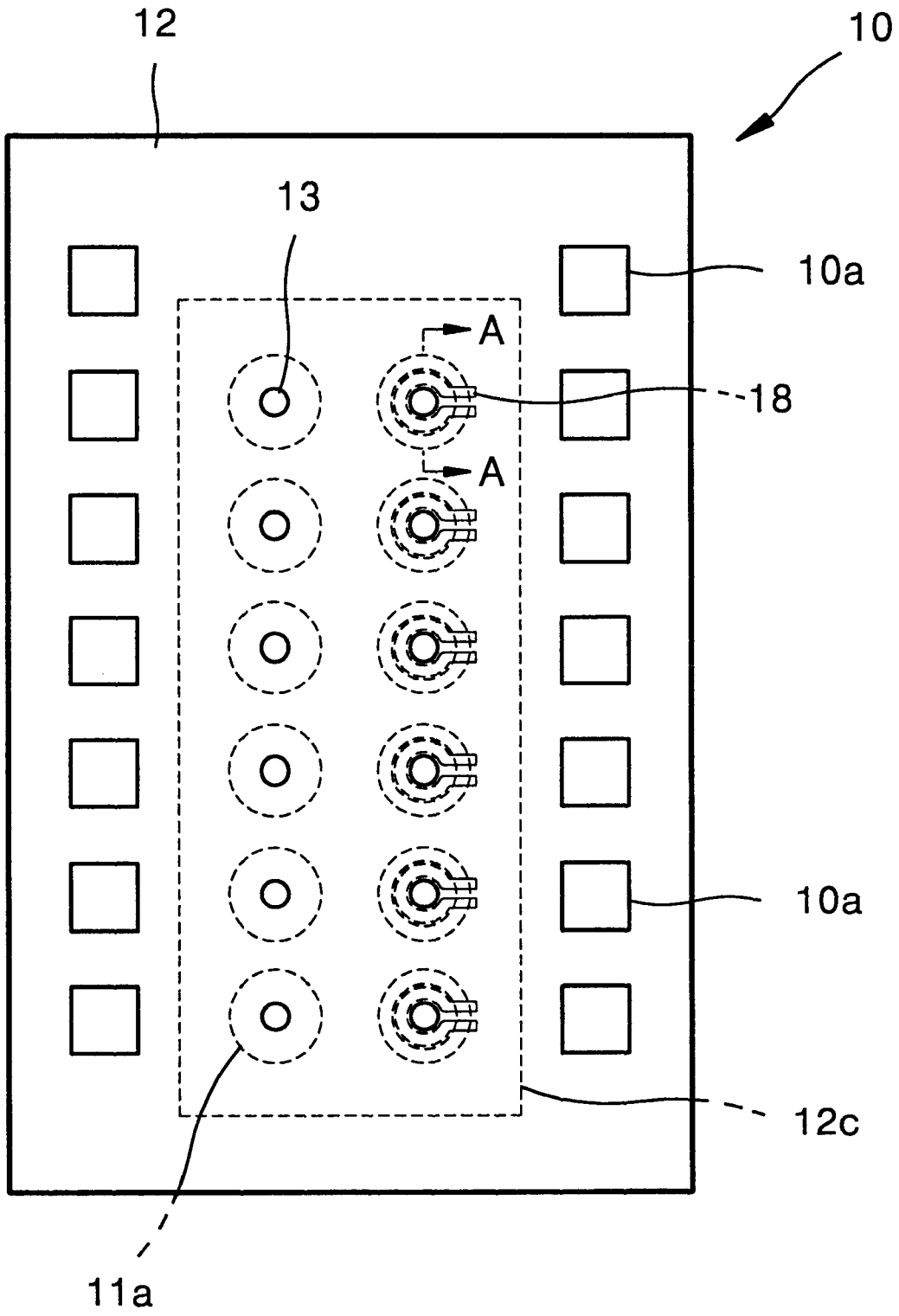
FIG. 2 is a schematic plan view of an ink-jet print head according to an embodiment of the present invention.
Figure 3:
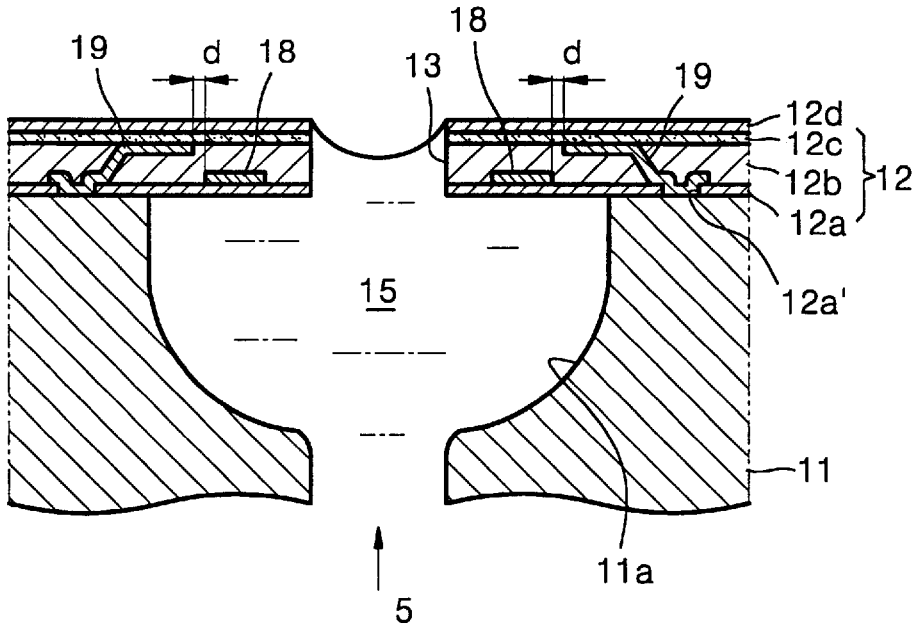
FIG. 3 is a schematic cross-sectional view of the ink-jet print head taken along line A—A of FIG. 2

FIG. 2 is a schematic plan view of an ink-jet print head 10 according to an embodiment of the present invention, and FIG. 3 is a schematic cross-sectional view taken along line A—A of FIG. 2, illustrating the arrangement of a nozzle 13, a heat element 18, and a thermal shunt 19 of the ink-jet print head 10 of FIG. 2.

As shown in FIG. 2, in the print head 10, a plurality of nozzles 13 are arranged on a nozzle plate 12 in a plurality of lines, for example two lines in this embodiment. The nozzle plate 12 is a membrane formed on a substrate 11 to be described later. A plurality of pads 10*a* are arranged in a line at predetermined intervals along long opposite sides of the print head 10. The pads 10*a* are terminals applying electric signals to corresponding heat elements 18, and a switching device, such as an electric line and a transistor, controlling the electric signals may be arranged between the pads 10*a* and the corresponding heat elements 18. Here, the switching device is positioned between the substrate 11 and the nozzle plate 12 and is formed through a generally known semiconductor manufacturing process on the substrate 11. A position and a structure of the switching device in the nozzle plate 12 may be easily formed through general techniques of the generally known semiconductor manufacturing process. Reference numerals 5, 11*a* and 12*c* denote an ink channel or passage having the same axis as the nozzle 13, a chamber and a thermal conduction layer, respectively.

Figure 4:
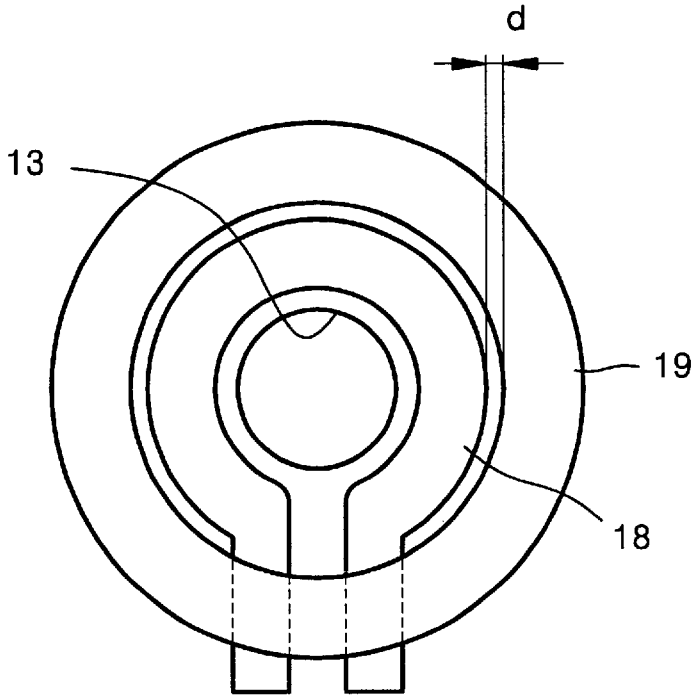
FIG. 4 illustrates an arrangement of a nozzle, a heat element, and a thermal shunt in the ink-jet print head of FIG. 3.

As shown in FIGS. 2 through 4, the nozzle 13 is surrounded by the heat element 18 as a circular heating unit, and has a central axis passing through a center line of the chamber 11*a* filled with ink 15 supplied through an ink channel in an ink channel or passage direction 5 parallel to the central axis and the center line and perpendicular to a major surface of the nozzle plate 12. As shown in FIGS. 3 and 4, a thermal shunt 19 surrounds the heat element 18 in a state where the thermal shunt 19 is spaced-apart from the heat element 18 by a predetermined horizontal distance 'd' in a horizontal direction parallel to the major surface of the nozzle plate 12. One side of the thermal shunt 19 is directly in contact with a surface of the substrate 11 through a first through hole 12*a'* of an underlying insulation layer 12*a,* and thus absorbed heat is rapidly transferred from the thermal shunt 19 to the substrate 11 formed of silicon (Si). Here, the predetermined horizontal distance 'd' is in the range where the thermal shunt 19 does not overlap the heat element 18 in the horizontal direction such that another side of the thermal shunt 19 maintains the predetermined horizontal distance 'd' from the heat element 18, and thereby preventing the thermal shunt 19 from being heated directly by heat generated from the heat element 18.

In addition, it is necessary that the thermal shunt 19 is sufficiently spaced-apart from the chamber 11*a* such that parts or portion, such as a metal forming the thermal shunt 19 disposed along a heat transfer path, do not affect the temperature of the ink in the chamber 11*a*. The heat always flows into the thermal shunt 19, and thus this flowing of the heat may cause the temperature of the ink 5 in the chamber 11*a* to be increased if the thermal shunt 19 is disposed too close the chamber 11*a*. When the temperature of the ink 15 increases, the viscosity of the ink 15 is lowered, and thus the lowered viscosity of the ink 15 may cause a bad influence on an ejection operation of the ink 5 and a printing performance of the ink-jet print head 10.

The thermal conduction layer 12*c* made of diamond like carbon (DIC) or silicon carbide (SiC) is formed on the thermal shunt 19. The thermal conduction layer 12*c* is electrically non-conductive and is made of a material having a very low heat resistance. The thermal conduction layer 12*c* is physically in contact with the thermal shunt 19 and is extended in the horizontal direction to cover the heat element 18. As shown in FIG. 2, the thermal conduction layer 12*c* covers the nozzles 13 and the chamber 11*a* and may be a single layer or divided into a plurality of layers or a plurality of regions. The thermal conduction layer 12*c* is formed on an intermediate insulation layer 12*b* to be spaced-apart from the heat element 18 by a predetermined second vertical distance in the vertical direction.

The intermediate insulation layer 12*b* is an electrical insulation material, is obtained through a stack of one or more insulation materials and is preferably formed of intermetal dielectric (IMD) material. A passivation layer 12*d* having a hydrophobic property is formed on an upper surface of the thermal conduction layer 12*c*. Since the DLC or SiC forming the thermal conduction layer 12*c* has large residual-stress and generates high compression stress, there is a limitation in increasing a thickness of the thermal conduction layer 12*c,* and the thickness of the thermal conduction layer 12*c* is about 0.3–0.5 $\mu$m. Thus, the passivation layer 12*d* is used to prevent an electrical short caused by the ink 15 penetrating the nozzle plate 12. An oxide formed through a plasma enhanced-chemical vapor deposition (PE-CVD) method is used as the passivation layer 12*d,* and a hydrophobic material, such as the DLC or fluorocarbon (FC), may be coated on the passivation layer 12*d* for hydrophobic processing in a case where the passivation layer 12*d* does not have the hydrophobic property.

In the above structure, the thermal conduction layer 12*c* is formed over the heat element 18, absorbs the heat generated from the heat element 18 and passed through the intermediate insulation layer 12*b,* and transfers the absorbed heat to the substrate 10 through the thermal shunt 19. According to the heat transfer structure, thermal accumulation on the nozzle plate 12 is suppressed, and thereby a series of operations, such as heat/vaporization/ejection of the ink 15 is smoothly performed.

As described above, the thermal conduction layer 12*c* covers the heat element 18 and maintains the predetermined second vertical distance from the heat element 18. When the thermal conduction layer 12*c* is spaced-apart the predetermined second distance from the heat element 18, the thermal conduction layer 12*c* is prevented from excessively absorbing the heat and a minimum amount of the heat is absorbed to avoid the excessive thermal accumulation on the nozzle plate 12. Since the thermal conduction layer 12*c* is formed of an inorganic matter such as the DLC or the SiC, the thermal stress caused by a difference in thermal expansion rates of materials stacked on upper and lower sides of the thermal conduction layer 12*c* is lowered, and thus the cracks due to thermal stress are prevented. The thermal shunt 19 made of a metallic material is spaced-apart from the heat element 18 by the predetermined horizontal distance not to overlap the heat element 18 in the horizontal direction and provides a path through which the heat from the thermal conduction layer 12*c* is passed. As a result, the thermal shunt 19 is not directly heated by the heat element 18 in the vertical direction, and the occurrence of the cracks is prevented.

The above embodiment illustrates an example of the ink-jet print head of the present invention and may be modified in various forms. according to the principles of the present invention, a different type of a thermal conduction structure connecting the thermal conduction layer 12*c* to the substrate 11 may be formed with a structural change of an electrode connected to the heat element 18 excluding the thermal shunt 19 as a separate element as described above. In the above structure, the thermal shunt 19 has a circular shape and completely surrounds the heat element 18 but may be partially formed around the heat element 18. Also, the thermal shunt 19 may not overlap the heat element 18.

Figure 5:
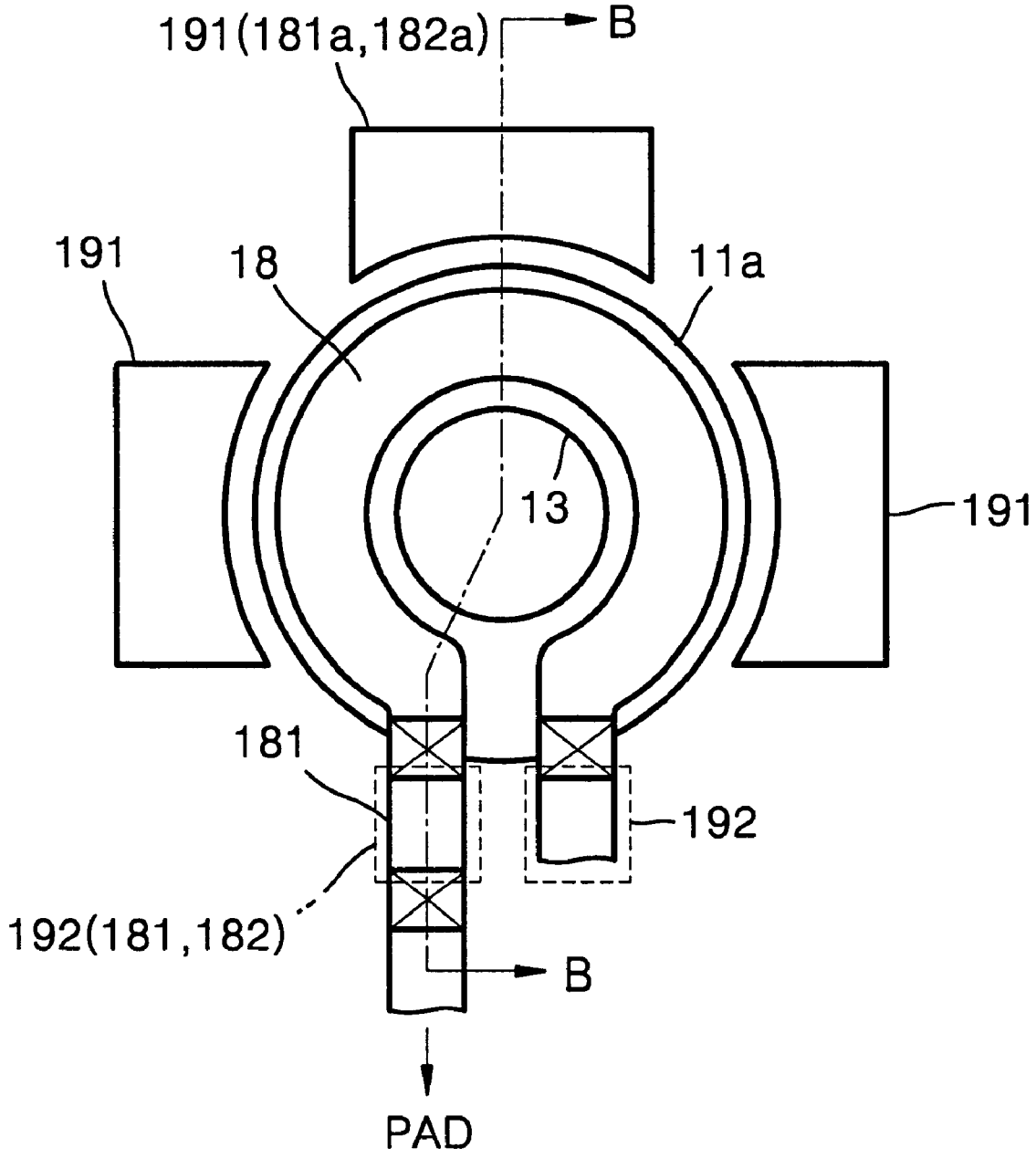
FIG. 5 illustrates an arrangement of the nozzle, the heat element, and the thermal shunt in the ink-jet pint head according to another embodiment of the present invention.
Figure 6:
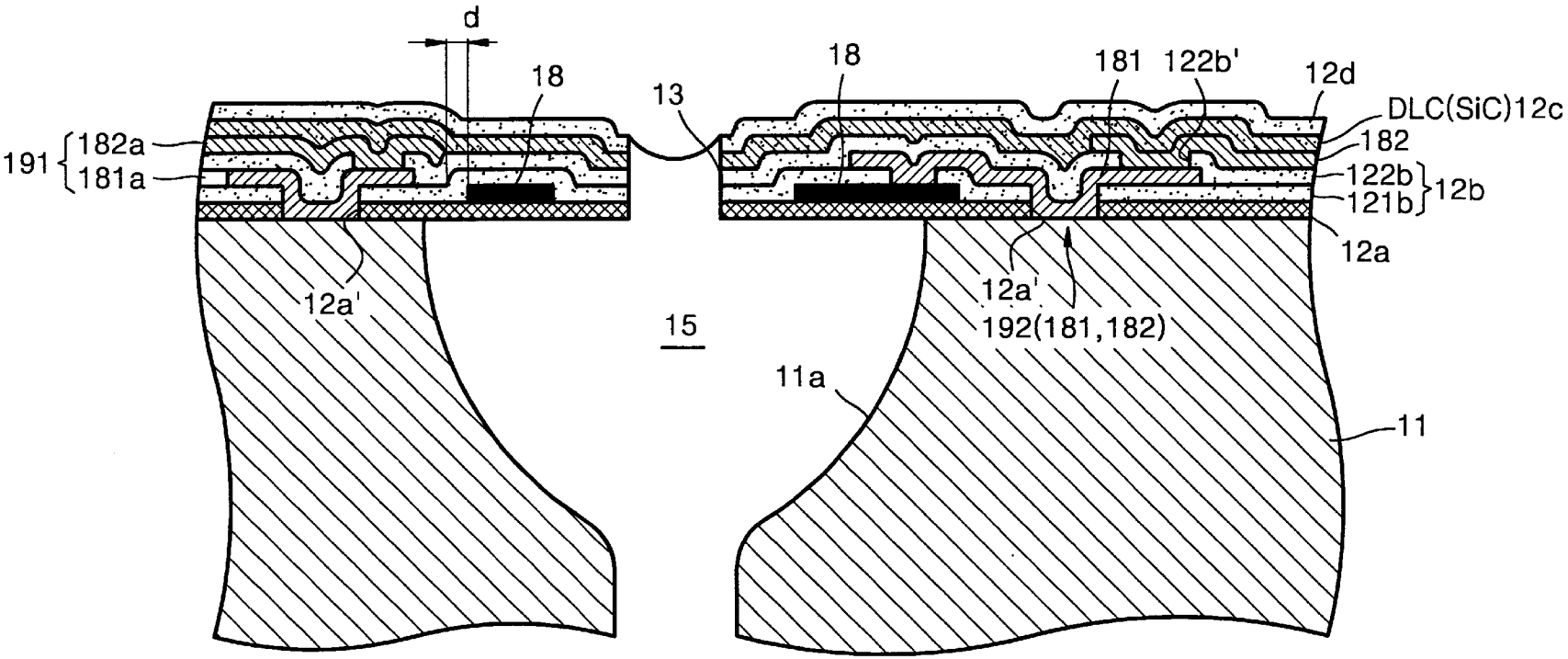
FIG. 6 is a cross-sectional view of the ink-jet print head taken along line B—B of FIG. 5.

FIG. 5 illustrates a structure having first and second thermal shunts 191 and 192 surrounding the heat element 18, and FIG. 6 is a cross-sectional view of the ink-jet print head taken along line B—B of FIG. 5.

As shown in FIG. 5, the first and second thermal shunts 191 and 192 are spaced-apart from the heat element 18 and disposed around the heat element 18 at a predetermined interval. As mentioned previously, the first and second thermal shunts 191 and 192 are physically in contact with the thermal conduction layer 12*c* and the substrate 11, and thus provide a path where thermal energy from the thermal conduction layer 12*c* is transmitted to the substrate 11. In such a case, the second thermal shunts 192 are also formed on first electrodes 181 formed on both ends the heat element 18 or may be formed on only one of the first electrodes 181 of the heat element 18 as a separate element. If the second thermal shunts 192 are formed on the first electrodes 181 at the both ends of the heat element 18, each of the two second thermal shunts 192 must be electrically separated from each other.

Referring to FIG. 6, the nozzle plate 12 is formed on a top of the substrate 11 in which the chamber 11*a* having a hemispheric shape is formed. The nozzle 13 having the central axis passing through the center of the chamber 11*a* is formed on the nozzle plate 12. The nozzle plate 12 is a membrane formed through a process of forming a thin film on the substrate 11.

The underlying insulation layer 12*a* of the nozzle plate 12 directly contacts the substrate 11 and is a SiOx layer formed through the PE-CVD method. The heat element 18 surrounding the nozzles 13 is formed on the underlying insulation layer 12*a,* and the intermediate insulation layer 12*b* is formed on the heat element 18. The intermediate insulation layer 12*b* includes a first intermediate insulation layer 121*b* and a second intermediate insulation layer 122*b,* and the first electrode 181 and a first metal layer 181*a* are formed between the first and second intermediate insulation layers 121*b* and 122*b*. The first electrode 181 and the first metal layer 181*a* are simultaneously formed of the same material such as aluminum. A second electrode 182 and a second metal layer 182*a* are formed on the second intermediate insulation layer 122*b*. The second electrode 182 and the second metal layer 182*a* are simultaneously formed of the same material as the aluminum. The second electrode 182 is physically and electrically connected to the first electrode 181 through a second through hole 122*b'* formed on the second intermediate insulation layer 122*b*. The second metal layer 182*a* is also physically in contact with the first metal layer 181*a* through the first through hole 12*a'*.

The first metal layer 181*a* and the second metal layer 182*a* in the above structure are elements of the first thermal shunt 191 having the same function as above and act as only the path for transferring the heat to the substrate, and the first electrode 181 and the second electrode 182 act as elements of the second thermal shunts 192 for providing the path for transferring the heat to the substrate 11 and further act as an electrical connector connected to the heat element 18.

The thermal conduction layer 12*c* having electrical insulation and high thermal conductivity such as the DLC or the SiC, is formed on the second electrode 182 and the second metal layer 182*a*. The thermal conduction layer 12*c* may be formed through the PE-CVD method, etc. The thermal conduction layer 12*c* is formed to cover all of the first and second thermal shunts 191, 192 and intermediate insulation layers 121*a,* 122*b,* absorbs redundant heat generated from the heat element 18 and exhausts the redundant heat to the substrate 11 through the first and second thermal shunts 191 and 192.

The passivation layer 12*d* is formed on the thermal conduction layer 12*c,* and a hydrophobic layer (not shown) may be formed on an outer surface of the passivation layer 12*d* in a case where the passivation layer 12*d* does not have the hydrophobic property.

Figure 7:
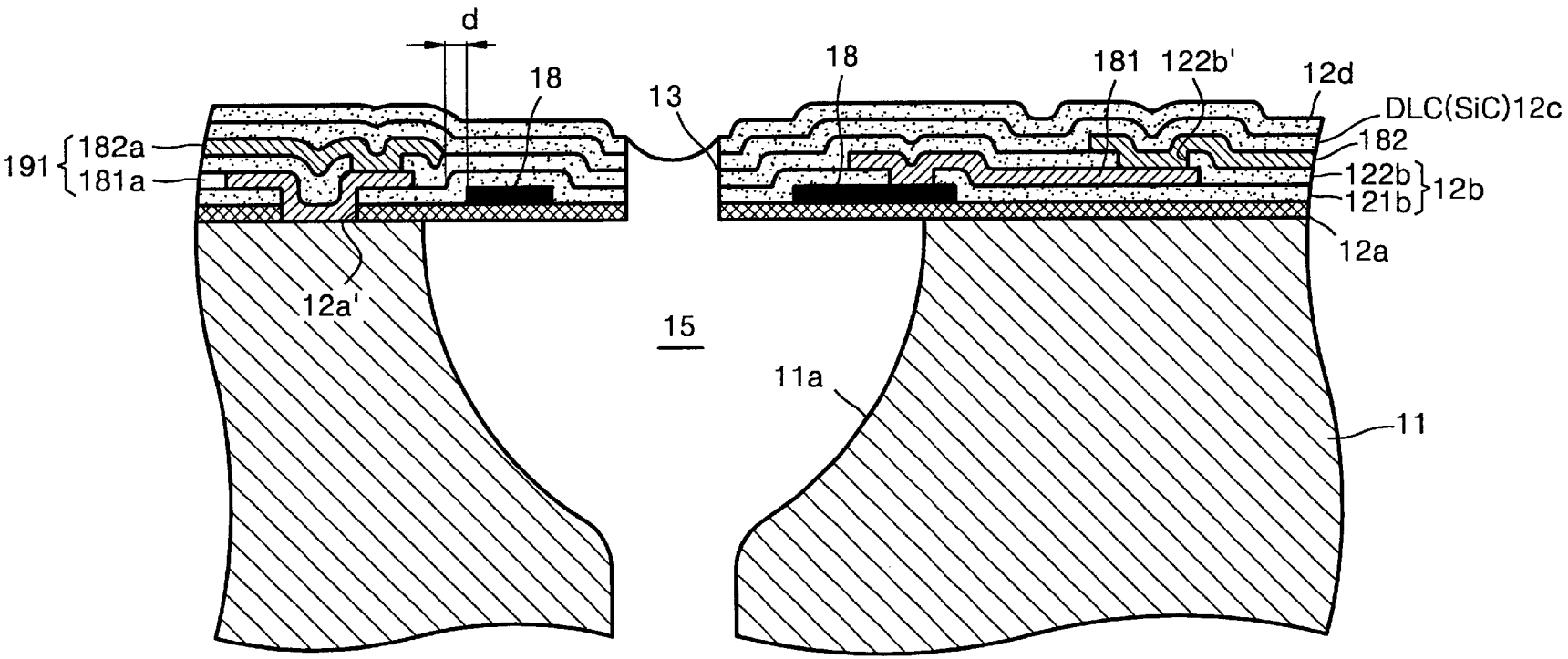
FIG. 7 schematically illustrates the ink-jet print head excluding the second thermal shunt from the nozzle plate of FIG. 6 according to another embodiment of the present invention.

According to a third embodiment of the present invention, as shown in FIG. 7, the second thermal shunt 192 is excluded from the nozzle plate 12 of FIG. 6, and only the first thermal shunt 191 is used. The first electrode 181 and the second electrode 182 are electrically in contact with each other through the second through hole 122*b'* of the second intermediate insulation layer 122*b* and are separated from the substrate 11 by the underlying insulation layer 12*a*. In FIG. 7, as shown in a left upper side of the chamber 11*a,* the first thermal shunt 191 directly contacting the substrate 11 is arranged on a portion where the first and second electrodes 181, 182 are not formed.

Figure 8:
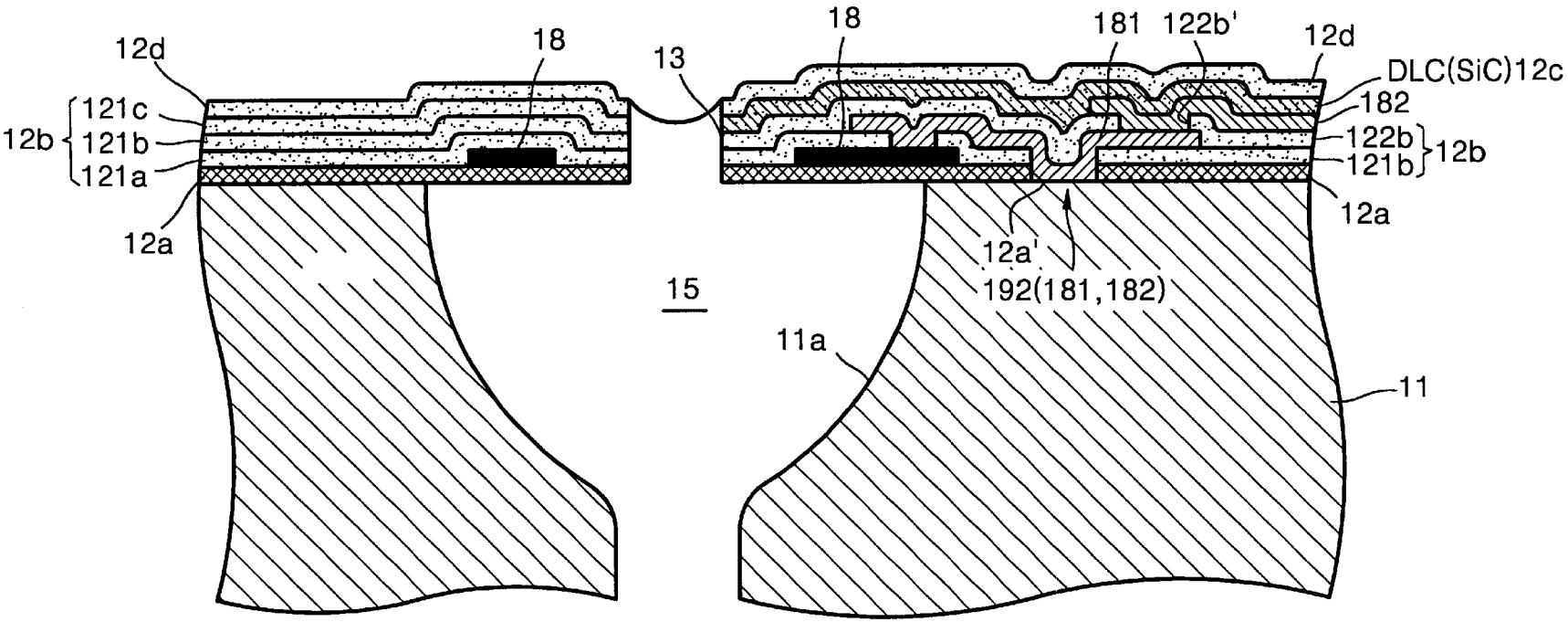
FIG. 8 schematically illustrates the ink-jet print head excluding the first thermal shunt from the nozzle plate of FIG. 6 according to another embodiment of the present invention.

According to a fourth embodiment of the present invention, as shown in FIG. 8, unlike the previous embodiment of FIG. 7, the first thermal shunt 191 is excluded from the nozzle plate 12 of FIG. 6, and only the second thermal shunt 192 is used. That is, the first electrode 181 and the second electrode 182, which are included in the second thermal shunt 192, are electrically in contact with each other through the second through hole 122*b'* of the second intermediate insulation layer 122*b,* and the first electrode 181 is directly in contact with the substrate 11 through the first through hole 12*a'*of the underlying insulation layer 12*a,* and the second electrode 182 is directly in contact with the thermal conduction layer 12 thereon, and thereby the path is provided where the heat absorbed into the thermal conduction layer 12*c* is directly transferred to the substrate 11.

As with the embodiments of FIGS. 7 and 8, the selective use of the first and second thermal shunts 191, 192 depends on the amount of the redundant heat on the nozzle plate 12 and other design matters. Of course, as with the embodiments of FIGS. 5 and 6, all of the first and second thermal shunts may be used.

In the ink-jet print head according to the present invention, an active element required to drive the heat element, such as a power transistor or a CMOS for constituting a logic circuit, is formed on the substrate. The active element is formed before the above membrane is formed on the substrate. The active element forms an electric circuit, such as the heat element.

According to the present invention, redundant heat generated from a heat element is not accumulated on a membrane but is rapidly absorbed into an inorganic thermal conduction layer existing in the membrane and is transferred to a bulk silicon substrate through a metallic thermal bridge. The redundant heat is rapidly exhausted to prevent a shortened lifetime of an ink-jet print head, and an ink droplet is rapidly and successively ejected under a high pressure. Thus, the ink-jet print head according to the present invention can be maintained in a stable condition for a long life time of the ink-jet print head, and due to a very quick response speed, the ink-jet print head is suitable for a high speed printing apparatus.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. An ink-jet print head comprising:

a substrate having a channel supplying ink;

a nozzle plate connected to the substrate and including a nozzle corresponding to the channel;

a heat element formed in the nozzle plate to surround the nozzle, having a first side facing the substrate and a second side opposite to the first side;

a thermal conduction layer formed in the nozzle plate to be spaced-apart from the second side of the heat element;

an intermediate insulation layer formed between the thermal conduction layer and the heat element; and a first thermal shunt formed in the intermediate insulation layer and spaced-apart from the heat element by a predetermined distance in a direction parallel to a major plane of the nozzle plate not to overlap the heat element, and connecting the thermal conduction layer to the substrate.

2. The print head of claim 1, wherein the thermal conduction layer is made of diamond like carbon (DLC) or silicon carbide (SiC).

3. The print head of claim 1, further comprising a passivation layer formed on an outer surface of the thermal conduction layer.

4. The print head of claim 3, further comprising a hydrophobic layer formed on the passivation layer.

5. The print head of claim 1, further comprising at least one electrode formed in the nozzle plate to supply current to the heat element, wherein the first thermal shunt is made of the same material as that of the electrode.

6. The print head of claim 5, wherein the first thermal shunt comprises first and second metal layers formed in the nozzle plate, the print head further comprising:

an insulation layer formed between the first and second metal layers; and a first through hole formed in the insulation layer to physically connect the first and second metal layers.

7. The print head of claim 6, wherein the electrode comprises a first electrode directly connected to the heat element, the print head further comprising:

a second electrode formed in the nozzle plate;

an insulation layer arranged between the first electrode and the second electrode; and a second through hole formed in the insulation layer to electrically connect the first electrode to the second electrode, wherein a second thermal shunt comprises the first and second electrodes.

8. The print head of claim 5, wherein the electrode comprises a first electrode directly connected to the heat element, the print head further comprising:

a second electrode formed in the nozzle plate;

an insulation layer arranged between the first electrode and the second electrode; and a first through hole formed in the insulation layer to electrically connect the first electrode to the second electrode.

9. The print head of claim 8, wherein the first electrode is directly in contact with the substrate, the second electrode is connected to the first electrode and directly in contact with the thermal conduction layer, and the first and second electrodes form the second thermal shunt.

10. The print head of claim 1, further comprising at least one additional thermal shunt, wherein the first thermal shunt and the additional thermal shunt surround the heat element at a predetermined interval.

11. An ink-jet print head, comprising:

a substrate having an inside wall defining an ink chamber;

a nozzle plate formed on the substrate, having a nozzle communicating with the ink chamber;

a heat element formed in the nozzle plate to surround the nozzle;

a thermal conduction layer formed in the nozzle pate and spaced-apart from the heat element; and a thermal shunt formed between and connecting the heat element and the thermal conduction layer, having a contact contacting the substrate, the contact being spaced-apart from the inside wall of the substrate by a predetermined distance.

12. The print head of claim 11, wherein the predetermined distance is greater than a distance between the ink chamber and the heat element.

13. The print head of claim 11, wherein the predetermined distance is greater than a distance between the thermal shunt and the heat element.

14. The print head of claim 11, wherein the nozzle plate includes a main portion and an extended portion, the main portion formed on the substrate while the extended portion is extended from one end of the inside wall of the substrate toward a center line of the ink chamber.

15. The print head of claim 14, wherein the heat element is disposed in the extended portion.

16. The print head of claim 14, wherein the heat element is spaced-apart from the substrate by a predetermined thickness.

17. The print head of claim 14, wherein said contact of the thermal shunt id disposed in the extended portion.

18. The print head of claim 11, wherein the thermal shunt includes a first portion and a second position connected to the first end portion, the first portion contacting the thermal conduction layer and spaced-apart from the heat element by a distance in a first direction parallel to a major surface of the nozzle plate.

19. The print head of claim 18, wherein the contact is formed on the second portion.

20. The print head of claim 18, wherein the first portion is spaced-apart from the heat element by a second distance in a second direction parallel to a central axis passing through a center line of the nozzle and the ink chamber.

21. The print head of claim 18, wherein the thermal shunt does not overlap with the heat element while the thermal conduction layer overlaps with the heat element.

22. The print head of claim 18, further comprising a thermal insulation layer formed in the nozzle plate and between the heat element and the substrate.

23. The print head of claim 22, wherein the thermal insulation layer contacts the substrate and includes a through hole allowing the contact of the thermal shunt to be in contact with the substrate.

24. The print head of claim 22, wherein the heat element is formed on the thermal insulation layer to be spaced-apart from the substrate by a thickness of the thermal insulation layer.

25. The print head of claim 22, wherein the thermal insulation layer includes a main portion contacting the substrate and a circular portion extended from the inside wall of the substrate toward a center line of the ink chamber and the heat element, and wherein the circular portion of the thermal insulation layer is not in contact with the substrate.

26. The print head of claim 22, further comprising an intermediate insulation layer formed within the nozzle plate and between the thermal insulation layer and the substrate, wherein the thermal shunt is formed in the intermediate insulation layer.

27. The print head of claim 22, further comprising an electrode formed between the thermal insulation layer and the nozzle plate, wherein the thermal shunt is simultaneously formed with the electrode on the thermal insulation layer.

28. The print head of claim 22, wherein the insulation layer is made of a material having a thermal conductivity lower than that of the thermal conduction layer.

29. The print head of claim 22, wherein the insulation layer is made of an inter-metal dielectric (IMD) material.

30. The print head of claim 11, wherein the thermal conduction layer has an electrical insulation characteristic, a very high thermal conductivity, and a low thermal expansion rate lower than a metal to prevent a crack caused by a thermal stress from being generated on the nozzle plate.

31. The print head of claim 30, wherein the thermal conduction layer is made of an inorganic material.

32. An ink-jet print head, comprising:

a substrate having an inside wall defining an ink chamber;

a nozzle plate formed on the substrate, having a nozzle communicating with the ink chamber;

a thermal insulation layer formed in the nozzle plate to contact the substrate;

a heat element formed on the thermal insulation layer to surround the nozzle;

an intermediate insulation layer formed on the thermal insulation layer and the heat element;

a thermal conduction layer formed on the intermediate insulation layer and spaced-apart from the heat element;

a passivation layer formed on the thermal conduction layer; and a thermal shunt formed in the intermediate insulation layer to pass heat from the thermal conduction layer to the substrate.

33. The print head of claim 32, wherein the thermal shunt includes a first end contacting the thermal conduction layer and a second end contacting the substrate through the thermal insulation layer.

34. The print head of claim 33, wherein the first end is spaced-apart from the heat element by a distance in a direction parallel to a surface disposed between the heat element and the substrate.

35. The print head of claim 33, wherein the second end includes a contact contacting the substrate, spaced apart from the inside wall of the substrate by a predetermined distance.

36. The print head of claim 32, wherein the thermal shunt comprises first and second metal layers formed in the intermediate insulation layer, the print head further comprising:

a second intermediate insulation layer formed between the first and second metal layer and having a first through hole through which the first metal layer contacts the second metal layer.

37. The print head of claim 36, further comprising a second through hole formed in the thermal insulation layer, wherein the first metal layer contacts the substrate through the second through hole of the thermal insulation layer.

38. The print head of claim 36, further comprising a second through hole formed in the second intermediate insulation layer, wherein the first metal layer contacts the second metal layer through the second through hole.

39. The print head of claim 36, wherein the second metal layer is spaced-apart from the heat element by a distance in a direction parallel to a surface between the nozzle plate and the substrate.

40. The print head of claim 36, further comprising:

a terminal formed on one end of the heat element;

a first electrode formed in the intermediate insulation layer to be directly connected to the terminal of the heat element;

a second electrode formed in the intermediate insulation layer to be connected to the first electrode; and a second intermediate insulation layer formed between the first electrode and the second electrode, having a second through hole formed on the second intermediate insulation layer, wherein the first electrode contacts the second electrode through the second through hole.

41. The print head of claim 32, further comprising at least one additional thermal shunt disposed around the heat element at a predetermined interval.

42. The print head of claim 41, further comprising a through hole formed in the thermal insulation layer, wherein one of the thermal shunts is in contact with the substrate through the through hole.

43. The print head of claim 42, further comprising a terminal portion and a non terminal portion formed on the heat element, wherein the one of the thermal shunts is disposed on the non-terminal portion while contacting the substrate.

44. The print head of claim 42, wherein another one of the thermal shunts is not in contact with the substrate.

45. The print head of claim 32, further comprising a terminal formed on one end portion of the heat element, wherein the thermal shunt contacts the terminal of the heat element to supply electrical power to the heat element.

46. The print head of claim 45, wherein the thermal shunt contacts the substrate.

47. An ink-jet print head, comprising:

a substrate;

a membrane formed on the substrate, including a nozzle, a heat element, an intermediate insulation layer, a thermal conduction layer formed on the intermediate insulation layer to be spaced-apart from the heat element, an outer layer formed on the thermal conduction layer, and a thermal bridge formed in the intermediate insulation layer and between the substrate and the thermal conduction layer to connect the thermal conduction layer to the substrate.

48. The print head of claim 47, wherein the thermal bridge is spaced-apart from the heat element by a predetermined distance in a direction parallel to a plane disposed between the substrate and the membrane.

49. The print head of claim 47, wherein the thermal conduction layer is made of diamond like carbon or SiC to absorb heat generated from the heat element and formed above the heat element with a predetermined distance in a direction parallel to a plane disposed between the substrate and the membrane.

50. An ink-jet print head, comprising:

a membrane comprising a substrate and a nozzle plate formed on the substrate; and the nozzle plate comprising:

a thermal insulation layer formed on the substrate;

a nozzle formed on the nozzle plate;

a heat element formed on a portion of the thermal insulation layer;

an intermediate insulation layer formed on the heat element and the thermal insulation layer other than the portion;

a thermal conduction layer formed on the intermediate insulation layer to be spaced-apart from the heat element;

an outer layer formed on the thermal conduction layer; and a thermal bridge formed in the intermediate insulation layer and between the substrate and the thermal conduction layer to connect the thermal conduction layer to the substrate.

* * * * *